US009518310B2

(12) United States Patent
Mourer et al.

(10) Patent No.: US 9,518,310 B2
(45) **Date of Patent: *Dec. 13, 2016**

(54) SUPERALLOYS AND COMPONENTS FORMED THEREOF

(71) Applicant: General Electric Company, Schenectady, NY (US)

(72) Inventors: David Paul Mourer, Beverly, MA (US); Richard DiDomizio, Scotia, NY (US); Timothy Hanlon, Glenmount, NY (US); Daniel Yeuching Wei, Reading, MA (US); Andrew Ezekiel Wessman, Walton, KY (US); Kenneth Rees Bain, Loveland, OH (US); Andrew Martin Powell, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 423 days.

This patent is subject to a terminal disclaimer.

(21) Appl. No.: 13/948,463

(22) Filed: Jul. 23, 2013

(65) Prior Publication Data

US 2014/0205449 A1 Jul. 24, 2014

Related U.S. Application Data

(63) Continuation-in-part of application No. 12/474,580, filed on May 29, 2009, now Pat. No. 8,992,699.

(51) Int. Cl.

| | |
|---|---|
| ***C22C 19/05*** | (2006.01) |
| ***C22C 1/04*** | (2006.01) |
| ***C22F 1/10*** | (2006.01) |
| ***B22F 5/08*** | (2006.01) |
| ***C22C 30/00*** | (2006.01) |
| ***F01D 9/02*** | (2006.01) |
| *B22F 3/15* | (2006.01) |
| *B22F 3/20* | (2006.01) |

(52) U.S. Cl.

CPC ..... *C22C 19/056* (2013.01); *B22F 5/08* (2013.01); *C22C 1/0433* (2013.01); *C22C 19/057* (2013.01); *C22C 30/00* (2013.01); *C22F 1/10* (2013.01); *F01D 9/02* (2013.01); *B22F 3/15* (2013.01); *B22F 3/20* (2013.01); *B22F 2998/00* (2013.01)

(58) Field of Classification Search

CPC ..... C22C 19/056; C22C 19/057; C22C 30/00; C22C 1/0433; C22C 1/10

See application file for complete search history.

(56) References Cited

U.S. PATENT DOCUMENTS

| | | | |
|---|---|---|---|
| 3,576,681 | A | 4/1971 | Barker et al. |
| 3,655,458 | A | 4/1972 | Reichman |
| 3,748,192 | A | 7/1973 | Boesch |
| 3,890,816 | A | 6/1975 | Allen et al. |
| 4,121,950 | A | 10/1978 | Guimier et al. |
| 4,207,098 | A | 6/1980 | Shaw |
| 4,388,124 | A | 6/1983 | Henry |
| 4,685,977 | A | 8/1987 | Chang |
| 4,769,087 | A | 9/1988 | Genereux et al. |
| 4,814,023 | A | 3/1989 | Chang |
| 4,820,353 | A | 4/1989 | Chang |
| 4,888,064 | A | 12/1989 | Chang |
| 4,894,089 | A | 1/1990 | Henry |
| 4,957,567 | A | 9/1990 | Krueger et al. |
| 4,981,644 | A | 1/1991 | Chang |
| 4,983,233 | A | 1/1991 | Henry |
| 5,037,495 | A | 8/1991 | Henry |
| 5,055,147 | A | 10/1991 | Henry |
| 5,061,324 | A | 10/1991 | Chang |
| 5,080,734 | A | 1/1992 | Krueger et al. |
| 5,087,305 | A | 2/1992 | Chang |
| 5,104,614 | A | 4/1992 | Ducrocq et al. |
| 5,124,123 | A | 6/1992 | Henry |

(Continued)

FOREIGN PATENT DOCUMENTS

| | | | |
|---|---|---|---|
| CA | 1233675 | A | 3/1988 |
| CA | 1334799 | C | 3/1995 |

(Continued)

OTHER PUBLICATIONS

Unofficial English translation of Office Action issued in connection with corresponding JP Application No. 2010-121131 on Sep. 2, 2014.

(Continued)

*Primary Examiner* — Jessee Roe

(74) *Attorney, Agent, or Firm* — General Electric Company; William Scott Andes

(57) ABSTRACT

A gamma prime nickel-base superalloy and components formed therefrom that exhibit improved high-temperature dwell capabilities, including creep and hold time fatigue crack growth behavior. A particular example of a component is a powder metallurgy turbine disk of a gas turbine engine. The gamma-prime nickel-base superalloy contains, by weight: 16.0 to 30.0% cobalt; 9.5 to 12.5% chromium; 4.0 to 6.0% tantalum; 2.0 to 4.0% aluminum; 2.0 to 3.4% titanium; 3.0 to 6.0% tungsten; 1.0 to 4.0% molybdenum; 1.5 to 3.5% niobium; up to 1.0% hafnium; 0.02 to 0.20% carbon; 0.01 to 0.05% boron; 0.02 to 0.10% zirconium; the balance essentially nickel and impurities. The superalloy has a W+Nb−Cr value of at least −6, is free of observable amounts of sigma and eta phases, and exhibits a time to 0.2% creep at 1300° F. and 100 ksi of at least 1000 hours.

20 Claims, 4 Drawing Sheets

(56) References Cited

U.S. PATENT DOCUMENTS

| | | | | |
|---|---|---|---|---|
| 5,129,968 | A | 7/1992 | Henry | |
| 5,129,969 | A | 7/1992 | Henry | |
| 5,129,970 | A | 7/1992 | Henry | |
| 5,129,971 | A | 7/1992 | Henry | |
| 5,130,086 | A | 7/1992 | Henry | |
| 5,130,087 | A | 7/1992 | Henry | |
| 5,130,088 | A | 7/1992 | Henry | |
| 5,130,089 | A | 7/1992 | Henry | |
| 5,143,563 | A | 9/1992 | Krueger et al. | |
| 5,156,808 | A | 10/1992 | Henry | |
| 5,171,380 | A | 12/1992 | Henry | |
| 5,393,483 | A | 2/1995 | Chang | |
| 5,470,371 | A | 11/1995 | Darolia | |
| 5,476,555 | A | 12/1995 | Erickson | |
| 5,662,749 | A | 9/1997 | Chang | |
| 5,891,272 | A | 4/1999 | Raymond et al. | |
| 5,897,718 | A | 4/1999 | Hessell et al. | |
| 6,132,527 | A | 10/2000 | Hessell et al. | |
| 6,468,368 | B1 | 10/2002 | Merrick et al. | |
| 6,521,175 | B1 | 2/2003 | Mourer et al. | |
| 6,866,727 | B1 | 3/2005 | Hieber et al. | |
| 6,890,370 | B2 | 5/2005 | Merrick et al. | |
| 6,969,431 | B2 | 11/2005 | Hieber et al. | |
| 6,974,508 | B1 | 12/2005 | Gabb et al. | |
| 7,208,116 | B2 | 4/2007 | Manning et al. | |
| 7,740,724 | B2 | 6/2010 | Clemens | |
| 8,992,699 | B2 * | 3/2015 | Bain et al. | 148/428 |
| 2005/0142023 | A1 | 6/2005 | Voice et al. | |
| 2007/0160476 | A1 | 7/2007 | Cheng et al. | |
| 2007/0227630 | A1 | 10/2007 | Augustins Lecallier et al. | |
| 2010/0303665 | A1 | 12/2010 | Bain et al. | |
| 2010/0329883 | A1 | 12/2010 | Mourer et al. | |
| 2011/0203707 | A1 | 8/2011 | Mourer et al. | |
| 2011/0262299 | A1 | 10/2011 | Harada et al. | |
| 2013/0177442 | A1 | 7/2013 | Walker et al. | |

FOREIGN PATENT DOCUMENTS

| | | | |
|---|---|---|---|
| CN | 102076877 | A | 5/2011 |
| CN | 103119183 | A | 5/2013 |
| EP | 0924309 | A2 | 6/1999 |
| EP | 1195446 | | 10/2002 |
| EP | 1710322 | | 11/2006 |
| JP | 01165741 | A | 6/1989 |
| JP | 06212325 | A | 8/1994 |
| JP | 09157777 | A | 6/1997 |
| JP | 2007277721 | A | 10/2007 |

OTHER PUBLICATIONS

ASM International, Matreials Park, Ohio, ASM Specialty Handbook: Nickel, Cobalt, and Their Alloys, "Metallography and Microstructures of Heat Resistant Alloys", Dec. 2000, pp. 302-304.

PCT Search Report and Written Opinion issued in connection with corresponding PCT Application No. PCT/US2011/043313 on Jun. 4, 2012.

Unofficial English Translation of Japanese Office Action issued in connection with corresponding JP Application No. 2013518854 on May 19, 2015.

Canadian Alice Action issued in connection with Related CA Application No. 2704871 on Aug. 8, 2016.

Canadian Office Action issued in connection with Related CA Application No. 2704874 on Aug. 16, 2016.

Office Action issued in connection with corresponding CN Application No. 201480041751.6 on Sep. 5, 2016.

* cited by examiner

| | Al | B | C | Co | Cr | Hf | Mo | Nb | Ta | Ti | W | Zr | Ni |
|---|---|---|---|---|---|---|---|---|---|---|---|---|---|
| HL601 | 3.03 | 0.032 | 0.053 | 18.10 | 12.20 | 0.37 | 2.69 | 1.96 | 4.90 | 3.17 | 3.00 | 0.051 | 50.4 |
| HL602 | 3.09 | 0.023 | 0.053 | 17.90 | 12.00 | 0.39 | 2.63 | 2.01 | 4.95 | 2.52 | 4.60 | 0.051 | 49.8 |
| HL603 | 3.06 | 0.029 | 0.055 | 17.90 | 12.08 | 0.41 | 2.58 | 2.99 | 5.08 | 2.61 | 3.10 | 0.051 | 50.1 |
| HL604 | 3.05 | 0.032 | 0.055 | 17.98 | 12.22 | 0.39 | 2.56 | 2.97 | 5.04 | 3.05 | 4.45 | 0.050 | 48.2 |
| HL605 | 3.00 | 0.030 | 0.059 | 17.96 | 12.30 | 0.38 | 3.50 | 2.04 | 5.24 | 2.63 | 2.88 | 0.050 | 49.9 |
| HL606 | 3.06 | 0.040 | 0.050 | 18.02 | 12.10 | 0.36 | 3.48 | 2.00 | 4.80 | 3.07 | 4.48 | 0.050 | 48.5 |
| HL607 | 3.02 | 0.039 | 0.051 | 18.35 | 12.32 | 0.31 | 3.58 | 3.01 | 4.98 | 3.34 | 2.93 | 0.060 | 48.0 |
| HL608 | 3.00 | 0.032 | 0.050 | 17.87 | 12.12 | 0.40 | 3.73 | 3.00 | 5.01 | 2.32 | 4.45 | 0.050 | 48.0 |
| HL609 | 3.08 | 0.030 | 0.051 | 17.86 | 12.14 | 0.37 | 3.00 | 2.45 | 4.91 | 2.72 | 3.78 | 0.050 | 49.6 |
| HL610 | 3.28 | 0.022 | 0.052 | 18.30 | 11.93 | 0.35 | 2.94 | 1.55 | 4.92 | 3.14 | 2.96 | 0.050 | 50.5 |
| HL611 | 3.11 | 0.035 | 0.049 | 18.21 | 10.14 | 0.33 | 2.86 | 2.50 | 4.84 | 2.82 | 3.87 | 0.050 | 51.2 |
| HL612 | 2.96 | 0.036 | 0.054 | 17.88 | 12.14 | 0.40 | 3.05 | 3.56 | 4.67 | 2.50 | 3.72 | 0.060 | 49.0 |
| HL613 | 3.24 | 0.030 | 0.058 | 17.91 | 12.22 | 0.44 | 3.04 | 1.63 | 4.96 | 3.04 | 3.97 | 0.050 | 49.4 |
| HL614 | 3.22 | 0.028 | 0.052 | 17.65 | 12.04 | 0.42 | 2.50 | 1.52 | 5.08 | 3.06 | 5.01 | 0.050 | 49.4 |
| HL701 | 3.32 | 0.032 | 0.051 | 18.08 | 12.09 | 0.40 | 2.54 | 1.98 | 5.04 | 2.78 | 5.08 | 0.048 | 48.8 |
| HL702 | 3.30 | 0.024 | 0.050 | 18.10 | 10.02 | 0.38 | 2.54 | 1.97 | 5.03 | 2.78 | 4.35 | 0.050 | 51.4 |
| HL703 | 3.31 | 0.030 | 0.050 | 18.00 | 12.02 | 0.38 | 2.53 | 1.94 | 4.88 | 2.74 | 3.49 | 0.050 | 50.6 |
| HL704 | 3.22 | 0.032 | 0.050 | 18.00 | 10.12 | 0.42 | 2.52 | 1.99 | 5.11 | 2.84 | 3.42 | 0.050 | 52.2 |
| HL705 | 3.27 | 0.028 | 0.049 | 17.82 | 10.85 | 0.43 | 2.62 | 2.03 | 5.24 | 2.76 | 4.20 | 0.050 | 50.7 |
| HL706 | 3.19 | 0.032 | 0.050 | 19.84 | 11.02 | 0.45 | 2.56 | 1.98 | 5.22 | 2.82 | 4.23 | 0.050 | 48.6 |
| HL707 | 3.25 | 0.019 | 0.055 | 18.04 | 11.02 | 0.43 | 2.52 | 2.02 | 5.13 | 2.82 | 4.28 | 0.050 | 50.4 |
| HL708 | 3.36 | 0.032 | 0.060 | 17.96 | 10.80 | 0.00 | 2.52 | 2.04 | 5.15 | 2.89 | 4.30 | 0.050 | 50.8 |
| HL709 | 3.65 | 0.033 | 0.053 | 19.99 | 11.78 | 0.42 | 2.13 | 1.98 | 5.13 | 2.96 | 3.02 | 0.050 | 50.7 |
| HL710 | 3.32 | 0.030 | 0.050 | 19.94 | 11.66 | 0.41 | 2.95 | 2.40 | 5.84 | 2.43 | 4.92 | 0.050 | 46.0 |
| HL6XX Min | 2.96 | 0.02 | 0.05 | 17.65 | 10.14 | 0.31 | 2.50 | 1.52 | 4.67 | 2.32 | 2.88 | 0.05 | 47.97 |
| HL6XX Max | 3.28 | 0.04 | 0.06 | 18.35 | 12.32 | 0.44 | 3.73 | 3.56 | 5.24 | 3.34 | 5.01 | 0.06 | 51.19 |
| HL7XX Min | 3.19 | 0.02 | 0.05 | 17.82 | 10.02 | 0.00 | 2.13 | 1.94 | 4.88 | 2.43 | 3.02 | 0.05 | 46.00 |
| HL7XX Max | 3.65 | 0.03 | 0.06 | 19.99 | 12.09 | 0.45 | 2.95 | 2.40 | 5.84 | 2.96 | 5.08 | 0.05 | 52.23 |
| Combined | | | | | | | | | | | | | |
| Min | 2.96 | 0.02 | 0.05 | 17.65 | 10.02 | 0.00 | 2.13 | 1.52 | 4.67 | 2.32 | 2.88 | 0.05 | 46.00 |
| Max | 3.65 | 0.04 | 0.06 | 19.99 | 12.32 | 0.45 | 3.73 | 3.56 | 5.84 | 3.34 | 5.08 | 0.06 | 52.23 |

FIG. 2

SUPERALLOYS AND COMPONENTS FORMED THEREOF

CROSS REFERENCE TO RELATED APPLICATIONS

This is a continuation-in-part patent application of co-pending U.S. patent application Ser. No. 12/474,580, filed May 29, 2009, and published as U.S. Patent Application Publication No. 2010/0303665 to Bain et al. The contents of this prior application are incorporated herein by reference.

BACKGROUND OF THE INVENTION

The present invention generally relates to nickel-base alloy compositions, and more particularly to nickel-base superalloys suitable for components requiring a polycrystalline microstructure and high temperature hold time (dwell) capability, for example, turbine disks of gas turbine engines.

The turbine section of a gas turbine engine is located downstream of a combustor section and contains a rotor shaft and one or more turbine stages, each having a turbine disk (rotor) mounted or otherwise carried by the shaft and turbine blades mounted to and radially extending from the periphery of the disk. Components within the combustor and turbine sections are often formed of superalloy materials to provide acceptable mechanical properties while at elevated temperatures resulting from the hot combustion gases. Higher compressor exit temperatures in modern high pressure ratio gas turbine engines can also necessitate the use of high performance nickel superalloys for compressor disks, blisks, and other components. Suitable alloy compositions and microstructures for a given component depend on the particular temperatures, stresses, and other conditions to which the component is subjected. For example, airfoil components such as blades and vanes are often formed of equiaxed, directionally solidified (DS), or single crystal (SX) superalloys, whereas turbine disks are typically formed of superalloys that must undergo carefully controlled forging, heat treatments, and surface treatments such as peening to produce a polycrystalline microstructure having a controlled grain structure and desirable mechanical properties.

Turbine disks are often formed of gamma prime ($\gamma'$) precipitation-strengthened nickel-base superalloys (hereinafter, gamma prime nickel-base superalloys) containing chromium, tungsten, molybdenum, rhenium and/or cobalt as principal elements that combine with nickel to form the gamma ($\gamma$) matrix, and contain aluminum, titanium, tantalum, niobium, and/or vanadium as principal elements that combine with nickel to form the desirable gamma prime precipitate strengthening phase, principally $Ni_3(Al,Ti)$. Particularly notable gamma prime nickel-base superalloys include René 88DT (R88DT; U.S. Pat. No. 4,957,567) and René 104 (R104; U.S. Pat. No. 6,521,175), as well as certain nickel-base superalloys commercially available under the trademarks Inconel®, Nimonic®, and Udimet®. R88DT has a composition of, by weight, about 15.0-17.0% chromium, about 12.0-14.0% cobalt, about 3.5-4.5% molybdenum, about 3.5-4.5% tungsten, about 1.5-2.5% aluminum, about 3.2-4.2% titanium, about 0.5-1.0% niobium, about 0.010-0.060% carbon, about 0.010-0.060% zirconium, about 0.010-0.040% boron, about 0.0-0.3% hafnium, about 0.0-0.01 vanadium, and about 0.0-0.01 yttrium, the balance nickel and incidental impurities. R104 has a nominal composition of, by weight, about 16.0-22.4% cobalt, about 6.6-14.3% chromium, about 2.6-4.8% aluminum, about 2.4-4.6% titanium, about 1.4-3.5% tantalum, about 0.9-3.0% niobium, about 1.9-4.0% tungsten, about 1.9-3.9% molybdenum, about 0.0-2.5% rhenium, about 0.02-0.10% carbon, about 0.02-0.10% boron, about 0.03-0.10% zirconium, the balance nickel and incidental impurities.

Disks and other critical gas turbine engine components are often forged from billets produced by powder metallurgy (P/M), conventional cast and wrought processing, and spraycast or nucleated casting forming techniques. Gamma prime nickel-base superalloys formed by powder metallurgy are particularly capable of providing a good balance of creep, tensile, and fatigue crack growth properties to meet the performance requirements of turbine disks and certain other gas turbine engine components. In a typical powder metallurgy process, a powder of the desired superalloy undergoes consolidation, such as by hot isostatic pressing (HIP) and/or extrusion consolidation. The resulting billet is then isothermally forged at temperatures slightly below the gamma prime solvus temperature of the alloy to approach superplastic forming conditions, which allows the filling of the die cavity through the accumulation of high geometric strains without the accumulation of significant metallurgical strains. These processing steps are designed to retain the fine grain size originally within the billet (for example, ASTM 10 to 13 or finer), achieve high plasticity to fill near-net-shape forging dies, avoid fracture during forging, and maintain relatively low forging and die stresses. In order to improve fatigue crack growth resistance and mechanical properties at elevated temperatures, these alloys are then heat treated above their gamma prime solvus temperature (generally referred to as supersolvus heat treatment) to cause significant, uniform coarsening of the grains.

Though alloys such as R88DT and R104 have provided significant advances in high temperature capabilities of superalloys, further improvements are continuously being sought. For example, high temperature hold time (dwell) capability has emerged as an important factor for the high temperatures and stresses associated with more advanced military and commercial engine applications. As higher temperatures and more advanced engines are developed, creep and crack growth characteristics of current alloys tend to fall short of the required capability to meet mission/life targets and requirements of advanced disk applications. It has become apparent that a particular aspect of meeting this challenge is to develop compositions that exhibit desired and balanced improvements in creep and hold time (dwell) fatigue crack growth rate characteristics at temperatures of 1200° F. (about 650° C.) and higher, while also having good producibility and thermal stability. However, complicating this challenge is the fact that creep and crack growth characteristics are difficult to improve simultaneously, and can be significantly influenced by the presence or absence of certain alloying constituents as well as relatively small changes in the levels of the alloying constituents present in a superalloy.

U.S. Patent Application Publication No. 2010/0303665 to Bain et al. is directed to gamma prime nickel-base superalloys capable of exhibiting improved high-temperature dwell capabilities, including creep and hold time fatigue crack growth behavior, when appropriately processed to form a component having a polycrystalline microstructure, most notably turbine disks of gas turbine engines. In particular, Bain et al. disclose a gamma-prime nickel-base superalloy that contains, by weight, 16.0 to 30.0% cobalt, 11.5 to 15.0% chromium, 4.0 to 6.0% tantalum, 2.0 to 4.0% aluminum, 1.5 to 6.0% titanium, 1.0 to 5.0% tungsten, 1.0 to 5.0% molybdenum, up to 3.5% niobium, up to 1.0% hafnium, 0.02 to 0.20% carbon, 0.01 to 0.05% boron, 0.02 to 0.10% zirconium, the balance essentially nickel and impurities. While achieving considerable improvements in hold time properties as well as improvements in creep capabilities, for example, time to 0.2% creep at 1200° F. and 115 ksi (about 650° C. and about 790 MPa) of at least 1200 hours, further improvements are desired, particularly in terms of creep properties at higher temperatures, for example, 1300° F. (about 705° C.) and above.

BRIEF DESCRIPTION OF THE INVENTION

The present invention provides a gamma prime nickel-base superalloy and components formed therefrom that exhibit improved high-temperature capabilities, particularly creep at temperatures exceeding 1200° F. (about 650° C.).

According to a first aspect of the invention, a gamma-prime nickel-base superalloy contains, by weight: 16.0 to 30.0% cobalt; 9.5 to 12.5% chromium; 4.0 to 6.0% tantalum; 2.0 to 4.0% aluminum; 2.0 to 3.4% titanium; 3.0 to 6.0% tungsten; 1.0 to 4.0% molybdenum; 1.5 to 3.5% niobium; up to 1.0% hafnium; 0.02 to 0.20% carbon; 0.01 to 0.05% boron; 0.02 to 0.10% zirconium; the balance essentially nickel and impurities. The superalloy has a W+Nb−Cr value of at least −6, is free of observable amounts of sigma and eta phases, and exhibits a time to 0.2% creep at 1300° F. and 100 ksi of at least 1000 hours.

According to a second aspect of the invention, a gamma-prime nickel-base superalloy contains, by weight: 17.0 to 20.5% cobalt; 10.5 to 12.5% chromium; 4.5 to 5.5% tantalum; 3.0 to 3.4% aluminum; 2.5 to 2.9% titanium; 3.0 to 5.0% tungsten; 2.5 to 3.0% molybdenum; 1.8 to 2.2% niobium; up to 0.6 hafnium; 0.048 to 0.068% carbon; 0.015 to 0.04% boron; 0.04 to 0.06% zirconium; the balance essentially nickel and impurities. The superalloy has a W+Nb−Cr value of at least −6, is free of observable amounts of sigma and eta phases, and exhibits a time to 0.2% creep at 1300° F. and 100 ksi of at least 1000 hours.

Other aspects of the invention include components that can be formed from the alloys described above, particular examples of which include turbine disks and compressor disks and blisks of gas turbine engines.

A significant advantage of the invention is the potential for balanced improvements in high temperature dwell properties, particularly improvements in creep characteristics at temperatures above 1200° F. (about 650° C.), while also having good producibility and good thermal stability. Improvements in other properties are also believed possible, particularly if appropriately processed using powder metallurgy, hot working, and heat treatment techniques.

Other aspects and advantages of this invention will be better appreciated from the following detailed description.

BRIEF DESCRIPTION OF THE DRAWINGS

FIG. 2 contains a table listing a series of nickel-base superalloy compositions evaluated as potential compositions for use as a turbine disk alloy.

DETAILED DESCRIPTION OF THE INVENTION

Figure 1:
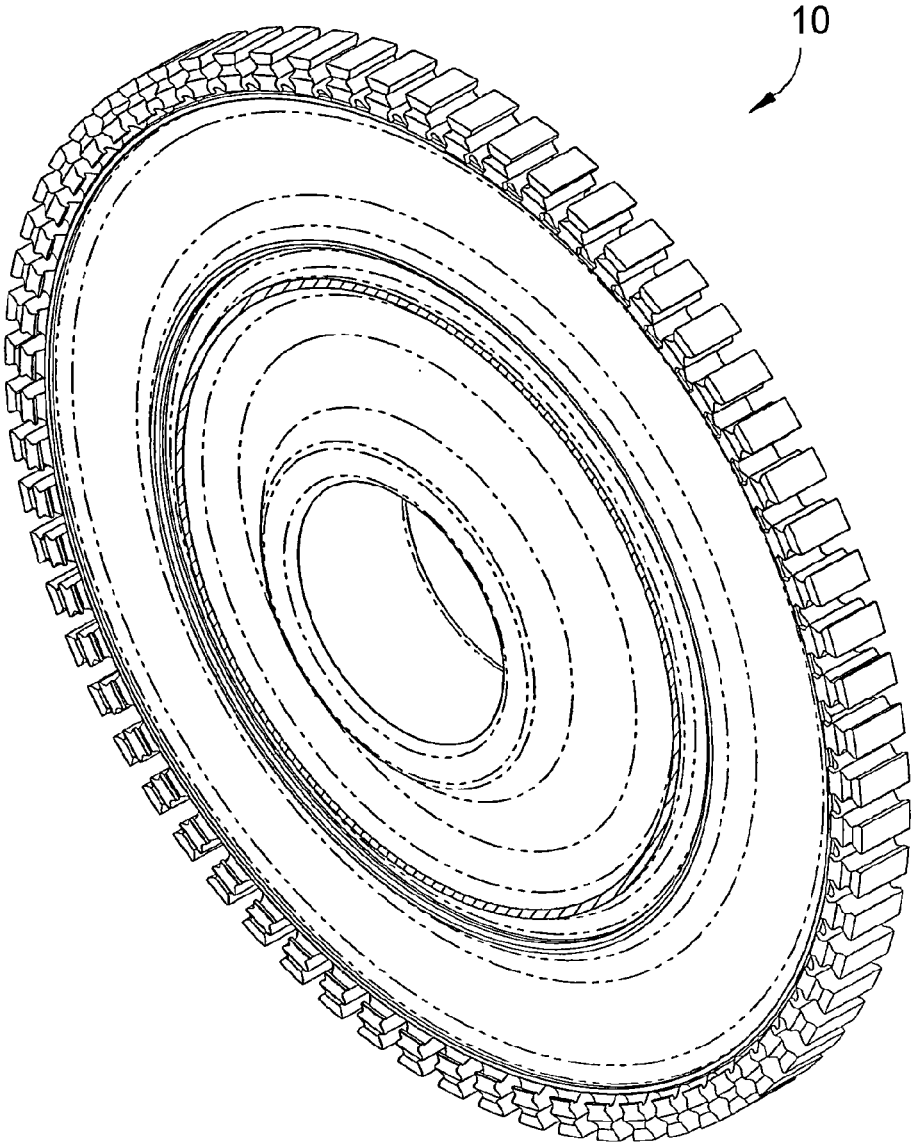
FIG. 1 is a perspective view of a turbine disk of a type used in gas turbine engines.

The present invention is directed to gamma prime nickel-base superalloys, and particular those suitable for components produced by a hot working (e.g., forging) operation to have a polycrystalline microstructure. A particular example represented in FIG. 1 is a high pressure turbine disk 10 for a gas turbine engine. The invention will be discussed in reference to processing of a high-pressure turbine disk for a gas turbine engine, though those skilled in the art will appreciate that the teachings and benefits of this invention are also applicable to compressor disks and blisks of gas turbine engines, as well as numerous other components that are subjected to stresses at high temperatures and therefore require a high temperature dwell capability.

Disks of the type shown in FIG. 1 are typically produced by isothermally forging a fine-grained billet formed by powder metallurgy (PM), a cast and wrought processing, or a spraycast or nucleated casting type technique. In a preferred embodiment utilizing a powder metallurgy process, the billet can be formed by consolidating a superalloy powder, such as by hot isostatic pressing (HIP) or extrusion consolidation. The billet is typically forged at a temperature at or near the recrystallization temperature of the alloy but less than the gamma prime solvus temperature of the alloy, and under superplastic forming conditions. After forging, a supersolvus (solution) heat treatment is performed, during which grain growth occurs. The supersolvus heat treatment is performed at a temperature above the gamma prime solvus temperature (but below the incipient melting temperature) of the superalloy to recrystallize the worked grain structure and dissolve (solution) the gamma prime precipitates in the superalloy. Following the supersolvus heat treatment, the component is cooled at an appropriate rate to re-precipitate gamma prime within the gamma matrix or at grain boundaries, so as to achieve the particular mechanical properties desired. The component may also undergo aging using known techniques.

In investigations reported by U.S. Patent Application Publication No. 2010/0303665 to Bain et al., potential superalloy compositions explored during investigations leading to the present invention were initially identified through the use of a proprietary analytical prediction process directed at identifying alloying constituents and levels capable of exhibiting better high temperature dwell capabilities than existing nickel-base superalloys. More particularly, the analysis and predictions made use of proprietary research involving the definition of elemental transfer functions for tensile, creep, hold time (dwell) crack growth rate, density, and other important or desired mechanical properties for turbine disks produced in the manner described above. Through simultaneously solving of these transfer functions, evaluations of compositions were performed to identify those compositions that appear to have the desired mechanical property characteristics for meeting advanced turbine engine needs, including creep and hold time fatigue crack growth rate (HTFCGR). The analytical investigations also made use of commercially-available software packages along with proprietary databases to predict phase volume fractions based on composition, allowing for the further definition of compositions that approach or in some cases slightly exceed undesirable equilibrium phase stability boundaries. Finally, solution temperatures and preferred amounts of gamma prime and carbides were defined to identify compositions with desirable combinations of mechanical properties, phase compositions and gamma prime volume fractions, while avoiding undesirable phases that could reduce in-service capability if equilibrium phases sufficiently form due to in-service environment characteristics. In the investigations, regression equations or transfer functions were developed based on selected data obtained from historical disk alloy development work. The investigations also relied on qualitative and quantitative data of the aforementioned nickel-base superalloys R88DT and R104.

Also in the investigations reported in U.S. Patent Application Publication No. 2010/0303665 to Bain et al., further criteria utilized to identify potential alloy compositions included the desire for a volume percentage of gamma prime ($(Ni,Co)_3(Al, Ti, Nb, Ta)$) greater than that of R88DT, with the intent to promote strength at temperatures of 1400° F. (about 760° C.) and higher over extended periods of time. A gamma prime solvus temperature of not more than 2200° F. (about 1200° C.) was also identified as desirable for ease of manufacture during heat treatment and quench.

As noted above, Bain et al. identified superalloy compositions capable of achieving considerable improvements in hold time properties as well as improvements in creep capabilities. A particular alloy identified in Bain et al. as Alloy E, referred to herein by its commercial name HL 11, exhibited particularly desirable improvements in hold time properties. A particular aspect of the present invention was to identify superalloy compositions capable of further improvements in creep properties in comparison to HL11. For this purpose, time to 0.2% creep at temperatures above 1200° F. (about 650° C.) was identified as desirable, with improved creep at temperatures of at least 1300° F. (about 705° C.) being specifically targeted. Based on the investigations reported in Bain et al., certain compositional parameters were maintained, including the inclusion of hafnium for high temperature strength, chromium levels of about 10 weight percent or more for corrosion resistance, aluminum levels greater than the nominal R88DT level to maintain gamma prime ($Ni_3(Al, Ti, Nb, Ta)$) stability, and cobalt levels sufficient to aid in minimizing stacking fault energy (desirable for good cyclic behavior) and controlling the gamma prime solvus temperature. The regression equations and prior experience further indicated that narrowly controlled and balanced levels of refractory metals, particularly titanium, tungsten, niobium, chromium, hafnium and tantalum, would likely be necessary to achieve the desired high temperature creep properties. Finally, regression factors relating to specific mechanical properties were utilized to narrowly identify potential alloy compositions that might be capable of exhibiting high temperature creep properties, and would not be otherwise identifiable without extensive experimentation with a very large number of alloys.

Of particular concern was thermodynamic instability resulting from high refractory metal contents. The investigations of Bain et al. evidenced that phase instability is often unpredictable, resulting in alloy compositions whose properties are far less than what had been predicted on the basis of analytical predictions utilizing elemental transfer functions. In particular, brittle intermetallic phases that can have significant detrimental effects on properties, including such topologically close packed (TCP) phases as delta (δ), sigma (σ), eta (η), alpha (α) (such as α-Cr), A, and P phases. Of these, sigma phase (generally (Fe,Mo)x(Ni,Co)y, where x and y=1 to 7) and eta phase ($Ni_3Ti$) were particularly detrimental to the properties of alloy compositions investigated by Bain et al. Experimentally, the presence of absence of detrimental levels of these phases can and were assessed during the investigation on the basis of whether an observable amount of one or more of these phases could be detected by an optical examination at a minimum of 500× utilizing suitably etched metallographic samples.

On the basis of the above, twenty-four alloy compositions were prepared and evaluated under a series of property tests that included not only high temperature creep at 1300° F. (about 705° C.), but also creep at higher temperatures, ultimate tensile strength (UTS), yield strength (YS), ductility, notched stress rupture (NSR), cycle and dwell fatigue crack growth rate (FCGR), low cycle fatigue (LCF), and sustained-peak low cycle fatigue (SPLCF). The alloy compositions generally fell within two chemistry groups, one of which was identified as HL601 through HL614 (collectively, referred to herein as the HL6XX alloys or alloy series), and the other HL701 through HL710 (collectively, referred to herein as the HL7XX alloys or alloy series). All of the alloys were targeted to have the following nominal levels, by weight, for certain alloy constituents: 3.2% Al; 0.030% B; 0.05% C; 2.5% Mo; 2.8% Ti, and 0.05% Zr. The twenty-four alloys evaluated were targeted to have narrower test chemistries than the HL11 alloy of Bain et al., specifically with respect to cobalt, chromium, niobium, tantalum and tungsten. The investigated ranges for these five elements were varied among the alloys to evaluate their effects on high temperature creep properties and detrimental TCP phases. Nominally, the cobalt levels were targeted over a range of about 18 to about 20 weight percent, the chromium levels were targeted over a range of about 10 to about 12 weight percent, the niobium levels were targeted over a range of about 1.5 to about 3.5 weight percent, the tantalum levels were targeted over a range of about 5 to about 6 weight percent, and the tungsten levels were targeted over a range of about 3 to about 5 weight percent. In addition, one of the HL7XX alloys (HL708) was evaluated with no intentional addition of hafnium. The actual chemistries of the HL6XX and HL7XX alloys are summarized in FIG. 2.

While the ranges of the investigated alloys overlap those of the composition for the HL11 alloy in Bain et al., the purpose of the experimental HL6XX and HL7XX alloys was to evaluate the possibility of improving creep properties at high temperatures through modifications of refractory metal content, while avoiding detrimental losses in properties due to TCP formation. As well known in the art, phase formations that occur in multicomponent systems (for example, the nickel-base superalloys of Bain et al. and the present invention) are a complex function of the elemental composition of the system. This is due to the complex thermodynamic interactions prevailing among the elements in a multicomponent system in an n-dimensional space, where n is the number of significant elements in the composition of the alloy. The effects of these interactions create situations wherein, at the same percentage content of an element, different phases can occur as the percentage contents of the other constituent elements vary, even when temperature and pressure are fixed. Due to the complex nature of multicomponent superalloy systems, it is not readily apparent as to what compositional ranges would exhibit improved properties, for example, creep or hold time, without simultaneously causing phase instability resulting in a drastic deterioration of the desired properties.

Figure 3:
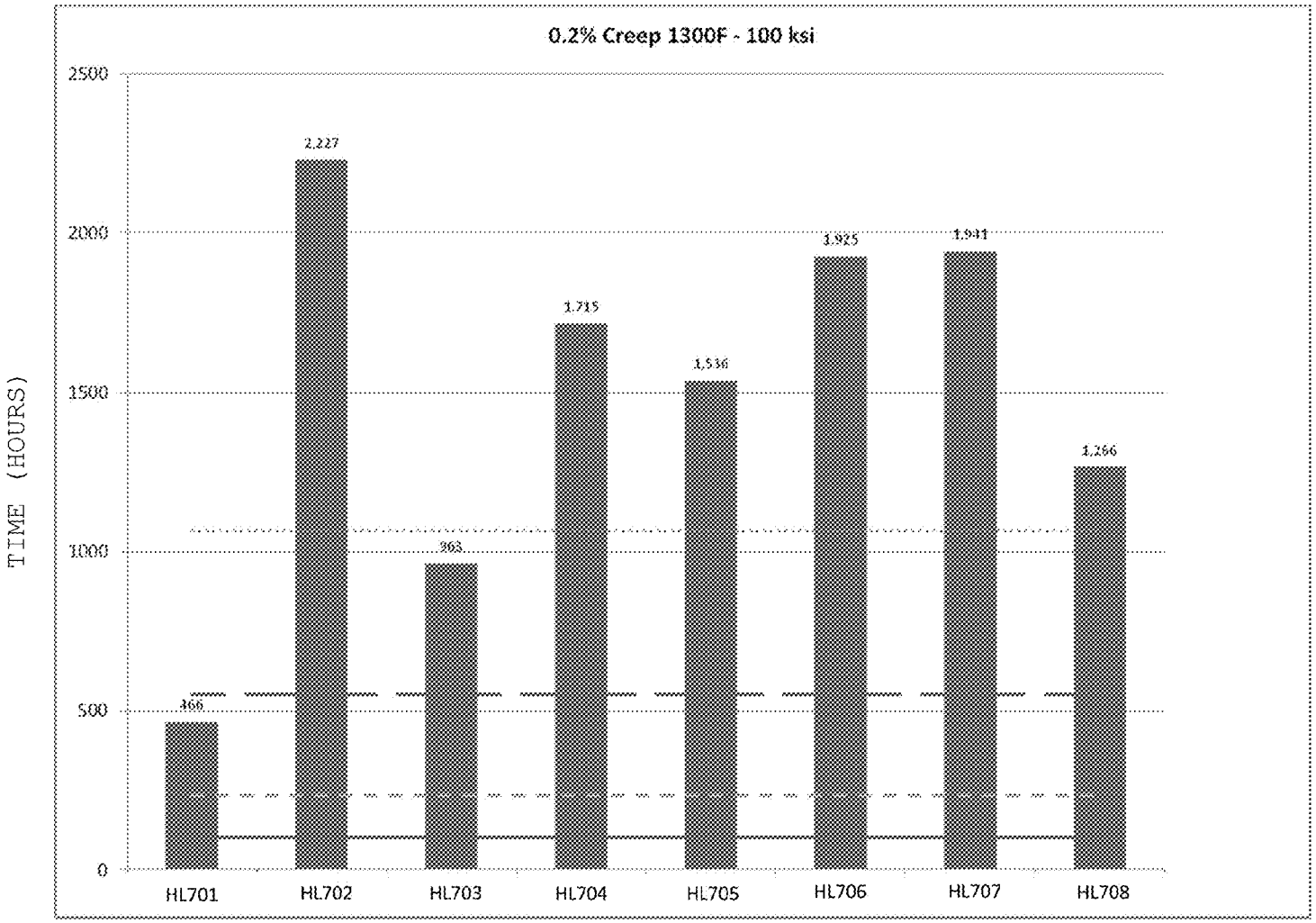
FIG. 3 is a bar graph representing 0.2% creep at 1300° F. and 100 ksi (about 705° C. and about 690 MPa) for eight of the experimental alloys listed in FIG. 2.

FIG. 3 is a bar graph representing the 0.2% creep at 1300° F. and 100 ksi (about 705° C. and about 690 MPa) of eight of the ten HL7XX alloys: HL701, HL702, HL704-HL708, and HL710. The best performing alloy, HL702, contained a relatively low amount of chromium (10.02 weight percent) relative to the targeted chromium range (10 to 12 weight percent), whereas the two poorest performing alloys, HL701 and HL703, had relatively high chromium levels (12.09 and 12.02 weight percent, respectively). The next five best-performing alloys, HL707, HL706, HL704, HL705, and HL708, had chromium contents of 11.02, 11.02, 10.12, 10.85, and 10.80 weight percent, respectively, suggesting that a critical level of chromium may exist between 11.02 and 12.02 weight percent within the compositional space of the experimental alloys. The six best-performing alloys had 0.2% creep lives exceeding 1000 hours, whereas HL701 and HL703 had creep lives of less than 1000 hours. The performance of HL701 was attributed to an observable amount of phase instability. Further analysis of these results suggested a positive influence from increasing tungsten and niobium levels in relation to decreasing chromium levels, with the result that their relationship was quantified with the equation W+Nb−Cr. The six best-performing alloys, HL702, HL704, HL705, HL706, HL707, and HL708, had W+Nb−Cr values of about −3.7, −4.7, −4.6, −4.8, 4.7, and −4.5, respectively, whereas HL703 had a W+Nb−Cr value of about −6.6.

Figure 4:
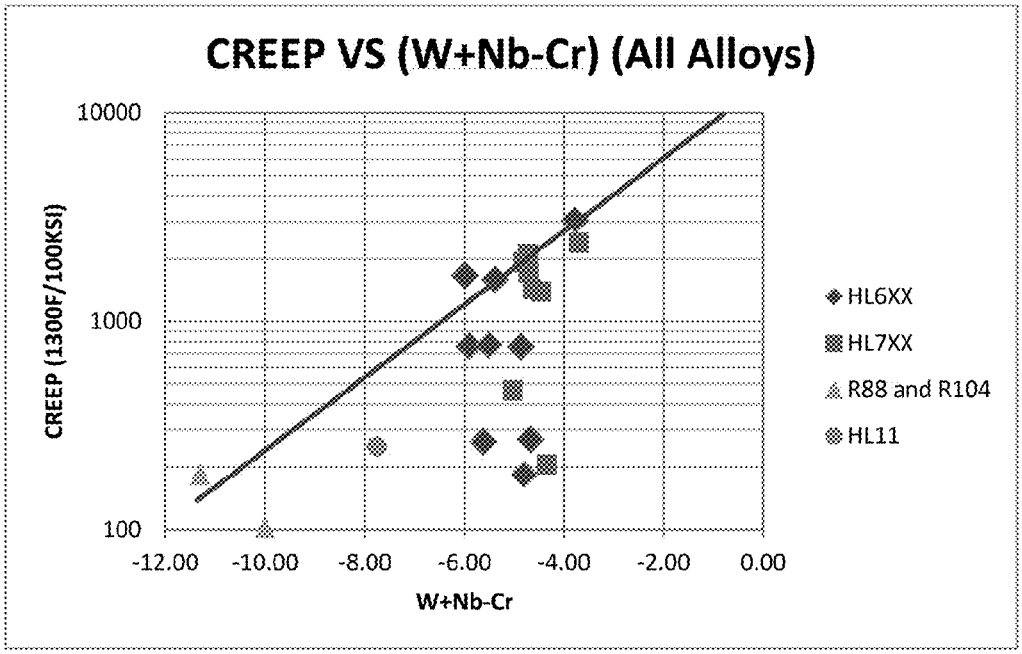
FIG. 4 is a graph plotting 0.2% creep at 1300° F. and 100 ksi (about 705° C. and about 690 MPa) for the eight experimental alloys of FIG. 3, as well as nine additional experimental alloys that were investigated and three alloys of the prior art.
Figure 5:
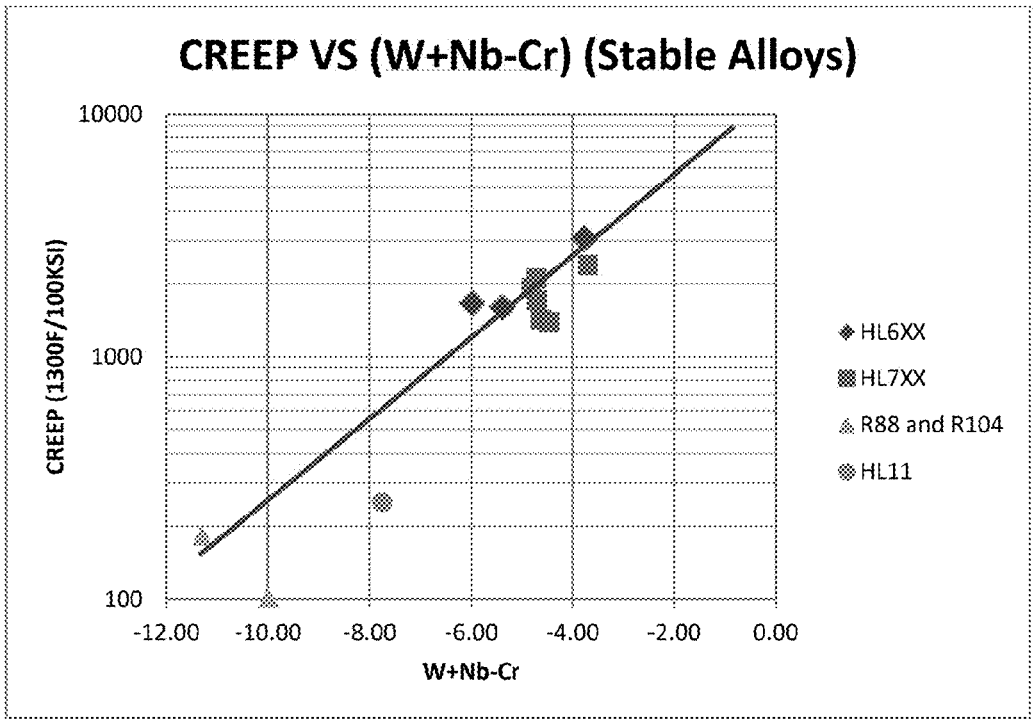
FIG. 5 is a graph plotting 0.2% creep at 1300° F. and 100 ksi (about 705° C. and about 690 MPa) for those experimental alloys of FIG. 4 that exhibited phase stability, as well as the three alloys of the prior art.

FIG. 4 plots 0.2% creep at 1300° F. and 100 ksi (about 705° C. and about 690 MPa) versus W+Nb−Cr value for nine alloys from the HL6XX series and eight alloys form the HL7XX series that exhibited comparable or improved creep properties compared to the HL11 alloy and the commercial alloys R88DT and R104. The plot shows that these alloys had W+Nb−Cr values of −6.0 or higher (approaching zero), and evidences that many of these HL6XX and HL7XX alloys exceeded HL11, R88DT, and R103 in terms of creep. Eight experimental alloys that had creep lives of less than 1000 hours were determined to be unstable, resulting in observable amounts of TCP phases. FIG. 5 contains the creep data for only the nine alloys whose creep properties were fairly tightly grouped above 1000 hours. This group included HL702, HL704, HL705, HL706, HL707, and HL708, consistent with the better-performing alloys of FIG. 3, as well as HL602, HL603, and HL611. The eight alloys with creep lives below 1000 hours had chromium contents above 11.5 weight percent, more often above 12 weight percent. Because these alloys were determined to contain detrimental TCP phases, particularly sigma and eta phases, their chemistries were concluded to be unstable. Furthermore, creep lives of 1000 hours or more were attributed to the absence of detrimental levels of sigma phase, eta phase, or other TCP phase in the alloys plotted in FIG. 5, which as defined herein refers to the superalloy being free of an observable amount of TCP, as previously defined.

Based on the investigation, the relative amounts of chromium, niobium, and tungsten were concluded to be critical for the purpose of achieving a creep life exceeding HL11 while avoiding observable amounts of sigma, eta, and other detrimental TCP phases. This relationship was concluded to be represented by the W+Nb−Cr value, and that a W+Nb−Cr value of −6 and higher (HL602, HL603, HL611, HL702, HL704, HL705, HL706, HL707 and HL708), was an indicator of a stable alloy that would exhibit a 0.2% creep life at 1300° F. and 100 ksi (about 705° C. and about 690 MPa) in excess of 1000 hours. Creep life and phase stability also appeared to be sensitive to chromium content. Because alloys with a W+Nb−Cr value of −6 and higher included HL602 and HL603 with chromium contents of 12.00 and 12.08%, respectively, a chromium content not exceeding 12.5 weight percent was concluded to be acceptable in combination with the ranges of the other alloying constituents, particularly tungsten and niobium. A minimum chromium content was concluded to be 9.5% based on results obtained with alloys having a W+Nb−Cr value of at least −6 and a chromium content of about 10% (HL611, HL702, and HL704). Finally, in comparing the compositions of those alloys that performed particularly well (HL602, HL603, HL611, HL702, HL704, HL705, HL706, HL707 and HL708) and the remaining alloys, it was evident that the chromium, molybdenum, niobium, titanium, and tungsten levels all had a significant impact on alloy properties, particularly creep.

It is worth noting that the levels of aluminum, boron, carbon, hafnium, molybdenum, tantalum, titanium, and zirconium were tested at nominal levels. It was concluded that acceptable ranges for these constituents can be broader than what was targeted, and that their levels were not critical as long as their levels were within ranges specified for HL11. From experience with the HL11 alloy in Bain et al., the titanium content was concluded to not influence instability at the tested levels of less than 3 weight percent. However, based on Bain et al. it was concluded that the titanium level should be limited to a maximum of 3.4 weight percent to avoid phase instability. In addition, the levels of molybdenum that were investigated were generally within the lower half of the molybdenum range for the HL11 alloy in Bain et al., which was done with the intent of reducing the risk of TCP phase formation. Though the level of cobalt was limited to a range of about 18 and 20 weight percent, cobalt was not considered to be critical as it freely substitutes for nickel in the gamma phase matrix.

On the basis of the above discussion and the six HL7XX alloys that performed well in FIGS. 3, 4 and 5, alloying ranges for nickel-base superalloy compositions of this invention are summarized in Table I below.

TABLE I

| Element | Broad | Narrower | Nominal |
|---|---|---|---|
| Co | 16.0-30.0 | 17.0-20.5 | 18.75 |
| Cr | 9.5-12.5 | 10.0-12.5 | 11.25 |
| Ta | 4.0-6.0 | 4.5-5.5 | 5.0 |
| Al | 2.0-4.0 | 3.0-3.4 | 3.2 |
| Ti | 2.0-3.4 | 2.5-2.9 | 2.7 |
| W | 3.0-6.0 | 3.0-5.0 | 4.0 |
| Mo | 1.0-4.0 | 2.5-3.0 | 2.75 |
| Nb | 1.5-3.5 | 1.8-2.2 | 2.0 |
| Hf | up to 1.0 | up to 0.6 | 0.4 |
| C | 0.02-0.20 | 0.048-0.068 | 0.058 |
| B | 0.01-0.05 | 0.015-0.04 | 0.03 |
| Zr | 0.02-0.10 | 0.04-0.06 | 0.05 |
| Ni | Balance | Balance | Balance |
| W + Nb—Cr | ≥−6.0 | ≥−6.0 | ≥−6.0 |

Though the alloy compositions identified in FIG. 2 and the alloys and alloying ranges identified in Table I were initially based on analytical predictions, the extensive analysis and resources relied on to make the predictions and identify these alloy compositions provide a strong indication for the potential of these alloys, and particularly the alloy compositions of Tables I, to achieve significant improvements in creep and hold time fatigue crack growth rate characteristics desirable for turbine disks of gas turbine engines.

While the invention has been described in terms of particular embodiments, including particular compositions and properties of nickel-base superalloys, the scope of the invention is not so limited. Instead, the scope of the invention is to be limited only by the following claims.

The invention claimed is:

1. A gamma-prime nickel-base superalloy comprises, by weight:

16.0 to 30.0% cobalt;
9.5 to 12.5% chromium;
4.0 to 6.0% tantalum;
2.0 to 4.0% aluminum;
2.0 to 3.4% titanium;
3.0 to 6.0% tungsten;
1.0 to 4.0% molybdenum;
1.5 to 3.5% niobium;
up to 1.0% hafnium;
0.02 to 0.20% carbon;
0.01 to 0.05% boron;
0.02 to 0.10% zirconium;
the balance essentially nickel and impurities;
wherein the superalloy has a W+Nb−Cr value of at least −6, is free of observable amounts of sigma and eta phases, and exhibits a time to 0.2% creep at 1300° F. and 100 ksi of at least 1000 hours.

2. The gamma-prime nickel-base superalloy according to claim 1, wherein the chromium content is 10.0 to 12.5 weight percent.

3. The gamma-prime nickel-base superalloy according to claim 1, wherein the niobium content is 1.8 to 2.2 weight percent.

4. The gamma-prime nickel-base superalloy according to claim 1, wherein the tungsten content is 3.0 to 5.0 weight percent.

5. The gamma-prime nickel-base superalloy according to claim 1, wherein the chromium content is 10.0 to 12.5 weight percent, the niobium content is 1.8 to 2.2 weight percent, and the tungsten content is 3.0 to 5.0 weight percent.

6. The gamma-prime nickel-base superalloy according to claim 1, wherein the titanium content is 2.5 to 2.9 weight percent.

7. The gamma-prime nickel-base superalloy according to claim 1, wherein the molybdenum content is 2.5 to 3.0 weight percent.

8. The gamma-prime nickel-base superalloy according to claim 1, wherein the gamma-prime nickel-base superalloy consists of, by weight:

16.0 to 30.0% cobalt;
9.5 to 12.5% chromium;
4.0 to 6.0% tantalum;
2.0 to 4.0% aluminum;
2.0 to 3.4% titanium;
3.0 to 6.0% tungsten;
1.0 to 4.0% molybdenum;
1.5 to 3.5% niobium;
up to 1.0% hafnium;
0.02 to 0.20% carbon;
0.01 to 0.05% boron;
0.02 to 0.10% zirconium;
the balance essentially nickel and impurities.

9. The gamma-prime nickel-base superalloy according to claim 8, wherein the chromium content is 10.0 to 12.5 weight percent.

10. The gamma-prime nickel-base superalloy according to claim 8, wherein the niobium content is 1.8 to 2.2 weight percent.

11. The gamma-prime nickel-base superalloy according to claim 8, wherein the tungsten content is 3.0 to 5.0 weight percent.

12. The gamma-prime nickel-base superalloy according to claim 8, wherein the chromium content is 10.0 to 12.5 weight percent, the niobium content is 1.8 to 2.2 weight percent, and the tungsten content is 3.0 to 5.0 weight percent.

13. The gamma-prime nickel-base superalloy according to claim 8, wherein the titanium content is 2.5 to 2.9 weight percent and the molybdenum content is 2.5 to 3.0 weight percent.

14. A component formed of the gamma-prime nickel-base superalloy of claim 8.

15. The component according to claim 14, wherein the component is a powder metallurgy component chosen from the group consisting of turbine disks and compressor disks and blisks of gas turbine engines.

16. A gamma-prime nickel-base superalloy consisting of, by weight:

17.0 to 20.5% cobalt;
10.0 to 12.5% chromium;
4.5 to 5.5% tantalum;
3.0 to 3.4% aluminum;
2.5 to 2.9% titanium;
3.0 to 5.0% tungsten;
2.5 to 3.0% molybdenum;
1.8 to 2.2% niobium;
up to 0.6% hafnium;
0.048 to 0.068% carbon;
0.015 to 0.04% boron;
0.04 to 0.06% zirconium;
the balance essentially nickel and impurities;
wherein the superalloy has a W+Nb−Cr value of at least −6, is free of observable amounts of sigma and eta phases, and exhibits a time to 0.2% creep at 1300° F. and 100 ksi of at least 1000 hours.

17. The gamma-prime nickel-base superalloy according to claim 16, wherein the chromium content is a maximum of 12.0 weight percent.

18. The gamma-prime nickel-base superalloy according to claim 16, wherein the chromium content is 10.02 to 12.08 weight percent, the niobium content is 1.97 to 2.99 weight percent, and the tungsten content is 3.1 to 4.6 weight percent.

19. A component formed of the gamma-prime nickel-base superalloy of claim 16.

20. The component according to claim 19, wherein the component is a powder metallurgy component chosen from the group consisting of turbine disks and compressor disks and blisks of gas turbine engines.

* * * * *